US007219442B2

(12) United States Patent
Laible

(10) Patent No.: US 7,219,442 B2
(45) Date of Patent: May 22, 2007

(54) DRYING METHOD

(75) Inventor: Reiner Laible, Bad Sackingen (DE)

(73) Assignee: Rosenmund VTZ AG, Liestal (CH)

( * ) Notice: Subject to any disclaimer, the term of this patent is extended or adjusted under 35 U.S.C. 154(b) by 26 days.

(21) Appl. No.: 10/513,133

(22) PCT Filed: Apr. 30, 2003

(86) PCT No.: PCT/CH03/00278

§ 371 (c)(1),
(2), (4) Date: Jun. 23, 2005

(87) PCT Pub. No.: WO03/093744

PCT Pub. Date: Nov. 13, 2003

(65) Prior Publication Data

US 2005/0262721 A1 Dec. 1, 2005

(30) Foreign Application Priority Data

May 2, 2002 (CH) ..... 0747/02

(51) Int. Cl.
*F26B 3/08* (2006.01)

(52) U.S. Cl. ..... 34/361; 34/368

(58) Field of Classification Search ..... 34/361, 34/368, 182, 185; 148/513
See application file for complete search history.

(56) References Cited

U.S. PATENT DOCUMENTS

| | | | | |
|---|---|---|---|---|
| 4,183,673 | A * | 1/1980 | Easley et al. | 366/76.2 |
| 4,674,692 | A | 6/1987 | Killer et al. | |
| 4,876,802 | A | 10/1989 | Gergely et al. | |
| 4,882,851 | A | 11/1989 | Wennerstrum et al. | |
| 5,939,071 | A | 8/1999 | Joseph | |
| 2002/0112792 | A1 * | 8/2002 | Kemp | 148/537 |

FOREIGN PATENT DOCUMENTS

| | | |
|---|---|---|
| DE | 44 41 350 C1 | 6/1996 |
| EP | 0 151 782 A1 | 8/1985 |
| EP | 0 203 598 A2 | 12/1986 |
| EP | 0 753 306 A1 | 1/1997 |

* cited by examiner

*Primary Examiner*—S. Gravini
(74) *Attorney, Agent, or Firm*—Tarolli, Sundheim, Covell & Tummino LLP

(57) ABSTRACT

The vacuum contact drying takes place in a device with a horizontally-arranged heated cylinder (1), a stirrer circulating with a very small wall separation, a blade (4) arranged on the stirrer and optionally an injection line (6), also arranged on the stirrer, for the introduction of liquid, gaseous, or vaporized media. According to the invention, the drying may be controlled whereby the value for the product temperature, the vacuum and the instantaneous evaporation power are continuously measured and regulated on the basis of the measured values.

6 Claims, 3 Drawing Sheets

DRYING METHOD

FIELD OF THE INVENTION

The invention relates to a method for the control of vacuum contact drying in a device with a horizontally arranged heated cylinder, with an agitator rotating with a very small wall clearance, and with a chopper arranged on the agitator.

BACKGROUND OF THE INVENTION

A device for mixing and/or communition is known from EP-A-0 203 598. It is know from EP-A-0 753 306 to use this device for the drying of plant extracts. The device described in this document is designed through mixing/communition as a vacuum contact drier for the use in the production of pharmaceutical active substances (API) and in the chemical and precision-chemical production and possesses a horizontally arranged heated cylinder with a heated agitator rotating in the latter about a horizontal axis.

The products to be dried are predominantly products of the pharmaceutical active substance industry and of the precision chemistry which contain, in addition to water, mostly organic solvents which are to be removed or are to be dried with a predetermined residual moisture content.

All the driers and methods known hitherto are characterized in that, in the first place, usually relatively long drying times occur. The product spectrum, that is to say the product properties, must in this case lie within a relatively narrow range, that is to say be highly standardized, so that in this case the products can be dried within acceptable times and in an at all reproduceable way. Some products, such as for example, liquids (solutions or suspensions), cannot be dried or can be dried only insufficiently and after adaptations (conversions).

Mostly, the wet products which are introduced into the drier for drying come from centrifugues or suction filters. The moisture contents of these wet products may fluctuate sharply, even within the same product. Moisture ranges of 20–50% by weight of moisture or more are possible. This wide fluctuation range makes it considerably more difficult, in conventional methods, to achieve similar or approximately identical drying times for the same material.

Physical properties of the products (viscosity, aggregation state solid or liquid, shrinkage), which occur or change in the course of the drying process, are an additional factor and in hitherto known systems often make it impossible to carry out drying completely to the desired final moisture or prolong the drying times to an extreme extent.

The dry products (finished products) must meet further requirements which are difficult to fulfill. These include as uniform a grain size and grain distribution (narrow size spectrum) as possible, so that the products can be made reproducible and standardizable.

These are requirements which have hitherto been fulfilled only inadequately. High additional outlay (redrying, milling, granulation) is often necessary in order to achieve these requirements.

A further important and often indispensable criterion in the production of active substances and precision-chemical products is the reproducibility of the drying results. What is meant by this is the achievement of virtually identical drying times for the same product which, however, originates as a whole from the plurality of batch dryings on the same apparatus. These properties include, inter alia, the final moisture, color and fineness of the material and the preservation of chemical and pharmaceutical effectiveness. Indirect properties are in this case the drying time and the energy consumption.

SUMMARY OF THE INVENTION

The object on which the invention is based is to provide a method which does not have the abovementioned difficulties or markedly reduces them, as compared with previous drying methods, and, in particular, makes it possible to process the most diverse initial products with the effect of achieving short and reproduciable drying times similar to one another, along with a constant product quality.

This object is achieved, according to the invention, in that the profile of the product temperature, the vacuum and the instantaneous evaporative capacity are continuously measured and are regulated on the basis of the measurement values.

The method, together with the device suitable for it, serves for carrying out vacuum dryings more effectively and makes it possible, in particular, to mix and distribute widely varying products so uniformly that an always uniform introduction of heat into the product is achieved. Vacuum control thereby becomes possible, which allows an evaporation of solvent or else solvent mixtures which at any time is controllable and uniform. This, in turn, reduces mechanical loads on product and machine and at the same time consequently extends the use of the device to products hitherto difficult to dry, such as suspensions, solutions or lumpy products.

A control automatically adaptable to the progress of the process makes it possible to use various drying parameters as a criterion in such a way that the process remains manageable and controllable at any time. Moreover, the parameters supply criteria for indexing conditions of the control, with the result that the process can be advanced continuously in such a way as to achieve an effective process flow which can then also be automated by means of self regulation.

BRIEF DESCRIPTION OF THE DRAWINGS

An exemplary embodiment of the invention is described below with reference to the accompanying drawings in which.

DETAILED DESCRIPTION OF THE INVENTION

Figure 2:
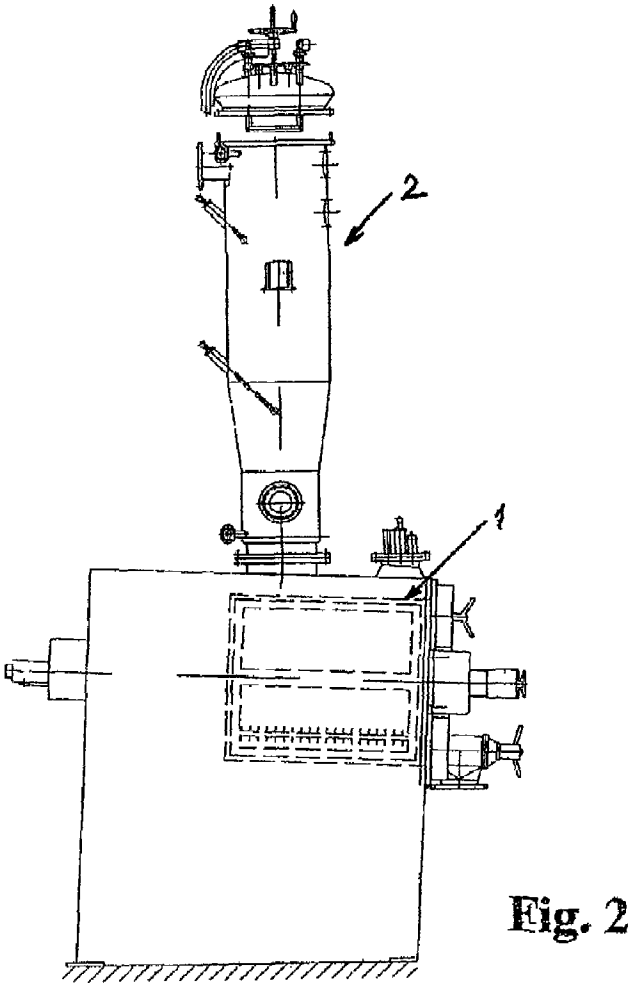
FIG. 2 shows a side view of the plant.
Figure 1:
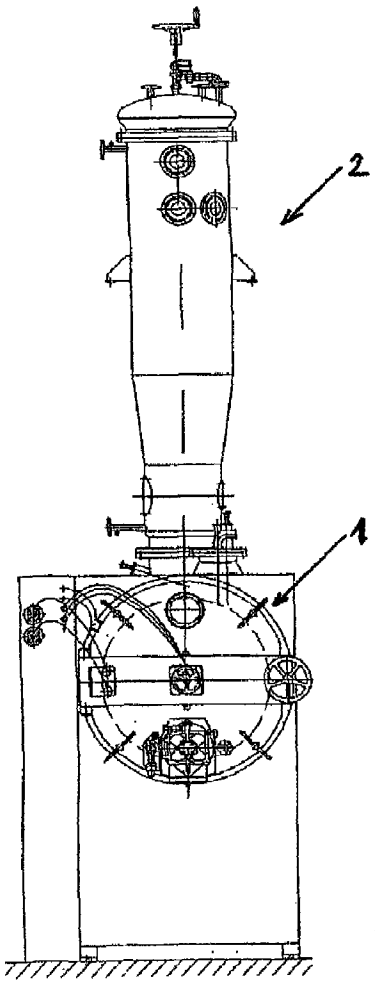
FIG. 1 shows a front view of a drier consisting of a boiler cylinder, a placed-on filter housing and a discharge valve.
Figure 3:
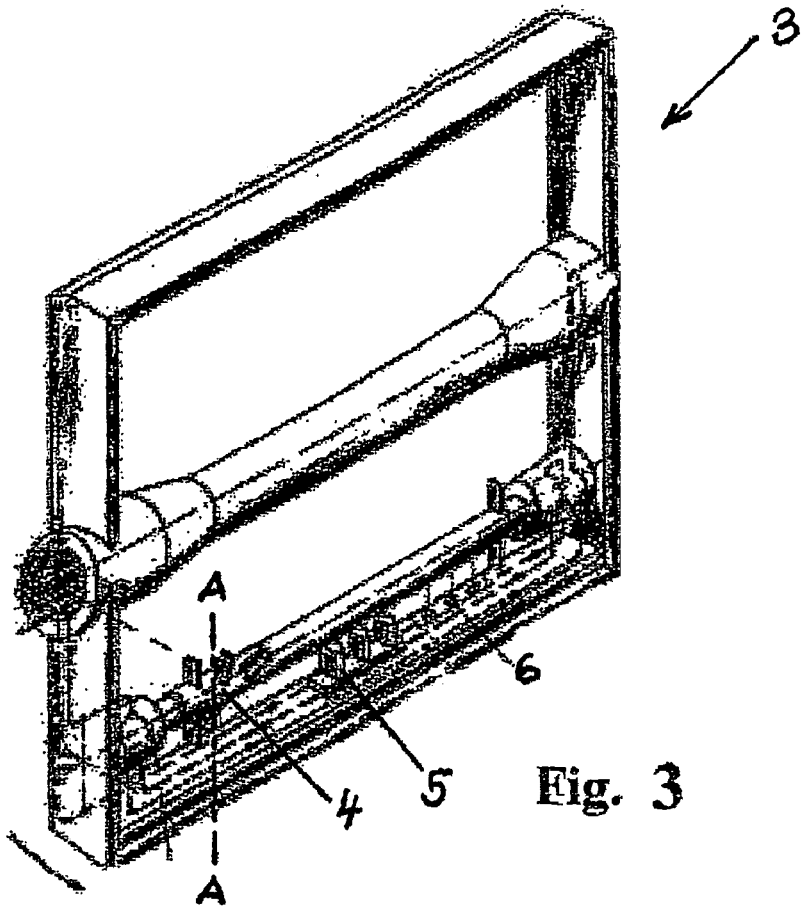
FIG. 3 shows a perspective view of the agitator with a chopper, stator and injection line as the most important components.

A known IUT drier, as it is referred to, is used for carrying out the method according to the invention. This possesses a boiler cylinder 1 arranged with a horizontal axis and hollowed out by lathe turning. The cylinder is similarly produced with double walls for heating, having welded-on heating ducts for channeling the heating medium fully over the entire cylinder area. Depending on the size of the machine, the heating medium is supplied separately in up to 3 heating duct units combined to form chambers. Completely uniform heating is consequently possible, without any appreciable intermediate cooling of the heating medium when it flows through the ducts. Furthermore, the rear wall and also the door are heated.

The boiler cylinder is equipped with a product feed system and with a dust filter 2 which, in turn, is connected in the conventional way to a condenser for solvent recovery with a following vacuum pump. The boiler cylinder has arranged in it an agitator 3 which is designed as a closed hollow profile with a pushed-in drive shaft and which is likewise heated. The drive shaft of the agitator is likewise arranged horizontally and coaxially with the boiler axis. Since the boiler cylinder is hollowed out by lathe turning, a very small clearance between agitator and wall of 1–5 mm, depending on the overall size of the machine, is possible. The blade sides on the cylinder wall and also the front and rear side have a wedge-shaped construction, in order to ensure with the direction of rotation that the product is lifted off from the cylinder wall, the rear wall and the front door. This ensures that virtually no or only a very thin product layer which only slightly influences the introduction of heat can be built up on the wall. A sufficient introduction of heat is thus always ensured at any time during the process.

The agitator possesses, on one blade side, a further agitating member (chopper) 4 which is driven at a substantially higher rotational speed than the agitator. This chopper, as it is known, is driven independently of the agitator at 40–400 times higher rotational speeds. Thus, when the agitator operates in the rotational speed range up to 20 rev/min, the chopper reaches up to 800 rev/min and more. Since the chopper is mounted on the agitator, it rotates constantly with the agitator and thus always arrives at the product to be processed or runs through the product together with the agitator. The chopper is independent of direction of rotation, that is to say it can run in the same direction of rotation as the agitator or can be changed over to the opposite direction of rotation during the drying process. The blades of the chopper have a knife shape and flat shape.

A comb 5, what is known as a stator, through which the material is drawn, may optionally be screwed to the agitator blade on the chopper side of the agitator. The blades of the stator, like the chopper, have a knife shape or flat shape. This is utilized according to the direction of rotation of the chopper. Consequently, in many instances, difficult material can be comminuted by hammering and/or cutting, and therefore a milling of the material may often also be achieved, if required, during drying.

Furthermore, the agitator is equipped with a rotating injection system 6. This is a line which is provided with nozzles and which is attached to the agitating blade behind the chopper and rotates together with the agitator. It is characteristic of the injection line that, depending on the machine size, there are three to seven nozzles through which three different types of medium can be supplied, to be precise liquids, gases or steam. Wetting (granulation), moistening and residual moisture discharge by means of gases as carrier gases for achieving the lowest possible final moistures are consequently possible.

Both product swirling and product indraw are possible by means of this arrangement. Phase changes (liquid/solid) and also lump formation can consequently be effectively counteracted at an early stage or prevented. As a result, a product state which is uniform for evaporation is maintained over the entire process. In conjunction with extremely small wall clearances (1–5 mm, depending on machine size), a uniform introduction of heat into the material is obtained, thus resulting in short drying times. The introduction of heat is in this case composed of the transition from wall to heap, heat transport in the heap and transmission between the individual particles. Owing to the chopper action, a uniformly fine material is produced.

The device thus equipped is capable of drying a wide spectrum of the most diverse products, to be precise from pourable products through those containing lumps to liquids (solutions or suspensions). The combination of agitator, chopper, stator and injection makes it possible to adapt the machine dynamically to the product properties changing during the drying operation, in such a way that a uniform evaporation and consequently a short drying time are achieved at all times.

Dryings are carried out in batch operation by means of the device described, the product being introduced into the cylinder and subsequently the agitator, heating and vacuum being started. The process flow is then characterized in that, initially, a relatively large amount of solvent is evaporated and, finally, drying takes place from inside the product, with the corresponding prolongation of the drying time. The desired final moisture in the material is ultimately reached, and, after cooling and pressure relief, the product can be unloaded through an outlet valve located in the front door.

The interaction of drier, vacuum system with condensation and heating/cooling, as components takes place according to a control which makes it possible to combine optimally the conventional process steps of filling, heating, evaporation and drying, cooling and product discharge. Criteria are in this case the variations in the product properties which are indirectly detected by the control which processes them and adapts settings.

Control criteria are in this case: the profile of the product temperature, the profile of the vacuum or of the evaporation, the distillate quantity and the heating/cooling temperatures. The product temperature and distillate quantity constitute in this case the key variables which determine the progress of the process and which supply the control with characteristic quantities for automatic adaption. Adaption in this case takes place via the vacuum and, for a small part, also via the heating temperature. The rotational speeds of the agitator and chopper and its direction of rotation are in this case auxiliary variables which are likewise taken into account. Further static-mechanical auxiliary variables, in addition, are the spacings of the knives of the stator and chopper which are determined by appropriate selection even before drying.

Figure 4:
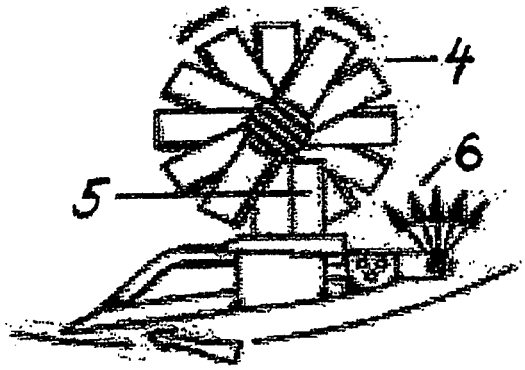
FIG. 4 shows a diagrammatic sectional illustration along the line A—A in FIG. 3.
Figure 5:
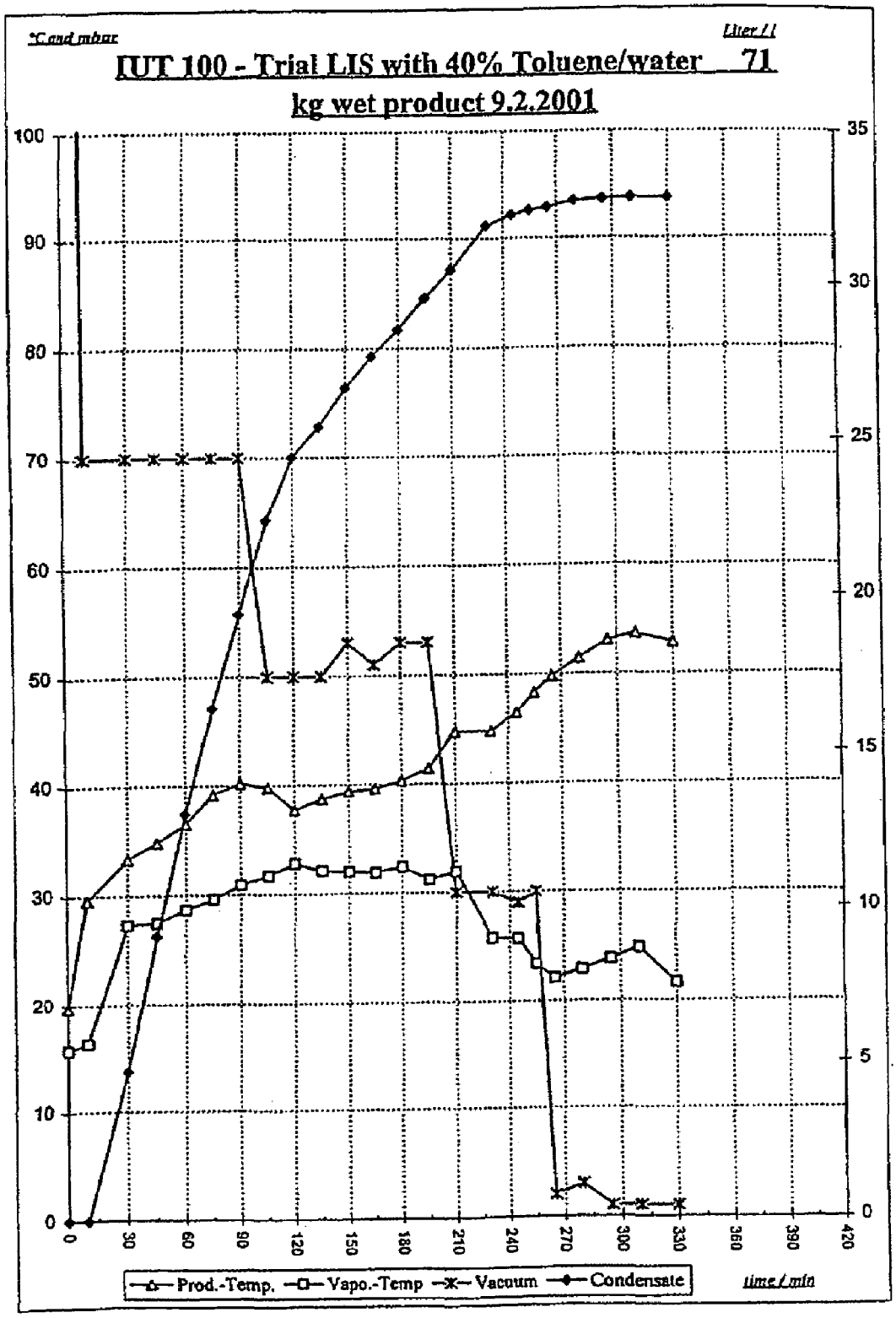
FIG. 5 shows a typical drying profile curve with a condensate quantity profile, product temperature profile, heating temperature profile and vacuum profile.

The setting of the parameters which are processed in the control is illustrated by means of the drying profile curves, shown in FIG. 4, of a vitamin precursor. This drying profile is typical of the product types mentioned, namely active substances (API=active pharmaceutical ingredients, for example antibiotics, antihistamines, etc), and precision chemicals, and also intermediate products, as is achieved by means of the device mentioned and the control criteria employed.

The drying time is illustrated in min on the abscissa, and the vacuum (mbar) and temperatures (heating temperature, product temperature, vapor temperature) are illustrated on the left ordinate. Finally, the right ordinate indicates the absolute evaporated solvent quantity in liters.

The product temperature profile, which shows no fall or only very slight falls, (max. 3–5° C.) during drying, and the vacuum regulated in steps are characteristic. The solvent curve shows a uniform rising profile which is typical of the corresponding control.

The method for effective control can be subdivided into four to approximately ten main stages, and indexing criteria can be defined from stage to stage. The number of stages depends on the type of product, the solvent and its evaporation characteristic (vapor pressure curve).

After introduction, first, the heating is set to the maximum temperature still permissible for the product, that is to say the desired value is set at this value and heating commences. The agitator and chopper run at medium rotational speeds, the chopper usually clockwise. This ensures a good mixing action. At the same time, for safety reasons, the vacuum is set at approximately 500–300 mbar according to the vapor pressure curve of the mostly easily volatile solvents. It is necessary in this case to ensure that evaporation which would lead to a lowering of the product temperature does not yet take place.

Finally, when the product temperature has reached about 30° C. (+–2° C.) and therefore energy has been introduced into the product, the next method stage can be started, that is to say the commencement of evaporation and of the actual drying operation. The vacuum is set at a value below the boiling point of the most easily volatile solvent, usually below 300 mbar. This gives rise to a uniform evaporation of solvent from the product, especially as long as there is free surface moisture according to the first drying segment. By setting the vacuum, then, the control ensures that the product temperature does not fall or falls only slightly, and only then is it ensured that no recondensation of solvent takes place in the product, particularly in the case of large filling volumes. This would lead to lumping. Furthermore, by the vacuum being maintained, too rapid an evaporation at the material surface, with shrinkage of the material or of the pores, is prevented. In the case of shrinkage of the pores, the transport of liquid in a second drying segment with controlled material transport would be seriously impeded, thus leading to very long drying times.

Should the product temperature nevertheless fall below a certain limit, the control adapts the vacuum with the effect of an impairment, in order to reduce evaporation and maintain the open pore state of the material or to prevent too rapid a shrinkage of the material.

This state of constant vacuum is preserved as long as, on the one hand, a constant evaporative capacity is maintained and, on the other hand, the product temperature remains constant or the rise does not overshoot certain limits.

In the event of a fall of the evaporative capacity, the multistep flow of actual drying up to the final product (dry product) commences. The vacuum is increased in stages of 20–30 mbar (stages of 10 mbar are also possible and expedient, depending on the product). The criteria up to the stage end are then again, as in the second stage, the evaporative capacity and the product temperature. Finally, the last stage is operated with the highest possible vacuum (typically approximately 3–5 mbar), until the required final moisture is achieved.

For most products, the required final moisture is in the range 0.5%–1.5%. In this case, a usable criterion has also proved to be the product temperature which, when the material is dry, is equal to the actual value of the jacket heating temperature; provided that a heating temperature which corresponds to the maximum permissible product temperature has been selected.

In conclusion, cooling and emptying of the product are carried out.

The device, with its excellent heat transmission as a result of effective heating (special ducts, multiple supply of the medium) and the mixing action (agitator, chopper, optionally with stator), affords the precondition of being capable of effectively applying the criteria mentioned, namely product temperature, vacuum and evaporative capacity. This applicability has proved to be transferable to virtually all types of products.

There are restrictions only with regard to products which have a third drying segment, that is to say which all have crystalline moisture and chemically bound water. Only the temperature level and the action time are critical here. Mixing and vacuum have only a slight effect in this case.

The invention claimed is:

1. A method of contact drying in a device having a heated cylinder in which a rotatable agitator has a blade which is disposed adjacent to a cylindrical inner side surface of the heated cylinder, said method comprising the steps of introducing a moist material which is to be dried into the heated cylinder, rotating the agitator relative to the heated cylinder to promote comminution and homogenization of the moist material, heating the moist material in the heated cylinder during rotation of the agitator, measuring the temperature of the moist material in the heated cylinder during rotation of the agitator and heating of the moist material, reducing the pressure in the heated cylinder to a pressure below atmospheric pressure during rotation of the agitator and heating of the moist material in the heated cylinder, said step of reducing the pressure in the heated cylinder includes reducing the pressure to a pressure below a vapor pressure of a solvent in the moist material during heating of the moist material in the heated cylinder, and preventing recondensation of solvent in the moist material by not allowing the temperature of the moist material to decrease by more than 5° C. during the heating of the moist material in the heated cylinder.

2. A method as set forth in claim 1 further including the step of rotating a chopper mounted on the agitator relative to the agitator as the agitator is rotated relative to the heated cylinder.

3. A method as set forth in claim 1 further including the step of discharging a fluid medium from nozzles mounted on the agitator as the agitator is rotated relative to the heated cylinder.

4. A method as set forth in claim 1 wherein said step of reducing the pressure in the heated cylinder is initiated after the moist material has been heated to a temperature of approximately 30° C.

5. A method as set forth in claim 1 wherein said step of reducing the pressure in the heated cylinder includes reducing the pressure in steps of 20 to 30 mbar.

6. A method as set forth in claim 1 wherein during a final portion of said step of heating the moist material in the heated cylinder is performed at a pressure of approximately 3 to 5 mbar.

* * * * *